US010828749B1

(12) United States Patent
Mardaus

(10) Patent No.: US 10,828,749 B1
(45) Date of Patent: Nov. 10, 2020

(54) VISE WITH IMPROVED STATIONARY JAW

(71) Applicant: Kurt Manufacturing Company, Inc., Minneapolis, MN (US)

(72) Inventor: Tyler Garrett Mardaus, Ramsey, MN (US)

(73) Assignee: KURT MANUFACTURING COMPANY, INC., Minneapolis, MN (US)

( * ) Notice: Subject to any disclaimer, the term of this patent is extended or adjusted under 35 U.S.C. 154(b) by 194 days.

(21) Appl. No.: 15/688,501

(22) Filed: Aug. 28, 2017

Related U.S. Application Data

(60) Provisional application No. 62/379,949, filed on Aug. 26, 2016.

(51) Int. Cl.

| | |
|---|---|
| ***B25B 1/24*** | (2006.01) |
| ***B25B 1/06*** | (2006.01) |
| ***B25B 1/02*** | (2006.01) |
| ***B25B 5/02*** | (2006.01) |

(52) U.S. Cl.
CPC ..... *B25B 1/2405* (2013.01); *B25B 1/02* (2013.01); *B25B 1/06* (2013.01); *B25B 1/24* (2013.01); *B25B 1/2484* (2013.01); *B25B 5/02* (2013.01)

(58) Field of Classification Search
CPC ..... B25B 1/2405; B25B 1/00; B25B 1/02; B25B 1/24; B25B 1/2484; B25B 1/2489; B25B 5/00; B25B 5/02; B25B 5/068
See application file for complete search history.

(56) References Cited

U.S. PATENT DOCUMENTS

| | | | | |
|---|---|---|---|---|
| 2,770,990 | A * | 11/1956 | Rix | B25B 1/2473 269/136 |
| D255,643 | S | 7/1980 | Speiser et al. | |
| 4,383,662 | A | 5/1983 | Feinberg | |
| 4,569,509 | A | 2/1986 | Good | |
| 4,706,949 | A * | 11/1987 | Dossey | B25B 1/24 269/283 |
| D309,701 | S | 8/1990 | Newmeyer et al. | |
| 5,096,172 | A | 3/1992 | Mills et al. | |
| 5,163,662 | A | 11/1992 | Bernstein | |
| 5,242,159 | A | 9/1993 | Bernstein | |
| 5,374,040 | A | 12/1994 | Lin | |
| D355,114 | S | 2/1995 | Wizman | |
| 5,442,844 | A | 8/1995 | Swann | |
| 5,505,437 | A | 4/1996 | Durfee, Jr. | |
| 5,683,077 | A | 11/1997 | Fink et al. | |

(Continued)

OTHER PUBLICATIONS

Application and figures for U.S. Appl. No. 29/575,615, filed Aug. 26, 2016.

*Primary Examiner* — Orlando E Aviles
*Assistant Examiner* — Aaron R McConnell
(74) *Attorney, Agent, or Firm* — Steven M. Koehler; Westman, Champlin & Koehler, P.A.

(57) ABSTRACT

A vise includes a vise body having a base with spaced apart rails joined to the base, each rail including a flange with a surface having a slot. A movable jaw assembly is slidable on the surfaces is driven by an actuator supported by the vise. A stationary jaw has a key configured to engage the slots and has a surface facing the movable jaw assembly. Fasteners secure the stationary jaw to the vise body, where all of the fasteners extend through the surfaces of the vise body between the slots and the surface of the stationary jaw facing the movable jaw assembly.

13 Claims, 4 Drawing Sheets

(56) References Cited

U.S. PATENT DOCUMENTS

| | | | | |
|---|---|---|---|---|
| 5,702,096 | A | | 12/1997 | Buck |
| 5,975,513 | A | | 11/1999 | Wolfe |
| D417,599 | S | | 12/1999 | Wolfe et al. |
| 6,012,712 | A | | 1/2000 | Bernstein |
| D420,880 | S | | 2/2000 | Lavigne et al. |
| D421,208 | S | | 2/2000 | Lavigne et al. |
| 6,022,010 | A | * | 2/2000 | Bernstein ..... B25B 1/2405 269/279 |
| 6,032,940 | A | * | 3/2000 | Wolfe ..... B25B 1/2405 269/136 |
| D422,868 | S | | 4/2000 | Lavigne et al. |
| 6,045,126 | A | | 4/2000 | Brzezinski |
| D432,886 | S | | 10/2000 | Hembroff |
| 6,164,635 | A | | 12/2000 | Chase et al. |
| D435,772 | S | | 1/2001 | Lavigne et al. |
| D436,012 | S | | 1/2001 | Lavigne et al. |
| D437,200 | S | | 2/2001 | Lavigne et al. |
| 6,217,014 | B1 | | 4/2001 | Wolfe |
| 6,250,620 | B1 | | 6/2001 | Durfee, Jr. |
| 6,598,867 | B2 | | 7/2003 | Martinez |
| 6,659,439 | B1 | | 12/2003 | Baumgartner et al. |
| 6,672,578 | B1 | | 1/2004 | Martens |
| 7,134,650 | B2 | | 11/2006 | Trudel et al. |
| 7,163,201 | B2 | | 1/2007 | Bernstein |
| D556,004 | S | | 11/2007 | Coope |
| 7,568,683 | B1 | | 8/2009 | Lovas |
| D640,521 | S | * | 6/2011 | Tschida ..... D8/74 |
| D647,381 | S | | 10/2011 | Lin |
| D666,072 | S | | 8/2012 | Tschida et al. |
| D716,627 | S | | 11/2014 | Lin |
| D785,431 | S | | 5/2017 | Lee |

* cited by examiner

VISE WITH IMPROVED STATIONARY JAW

CROSS-REFERENCE TO RELATED APPLICATION

The present application is based on and claims the benefit of U.S. provisional patent application Ser. No. 62/379,949, filed Aug. 26, 2016, the content of which is hereby incorporated by reference in its entirety.

BACKGROUND

The discussion below is merely provided for general background information and is not intended to be used as an aid in determining the scope of the claimed subject matter.

The disclosure relates to vises, and in particular to stationary jaws of vises to which workpieces are clamped against.

Stationary jaws are used on vises as a reaction structure. Although a stationary jaw can be integral with a vise body, in many vises the stationary jaw is fastened to the vise body. It is important in accurately machining workpieces that the workpiece be secured to the vise body so as to be in a known position relative to the device that is to impart work upon the workpiece such as but not limited to cutters, drills, etc. The workpiece is typically held against the stationary jaw with force imparted upon the workpiece through a movable jaw on the vise. Since the stationary jaw forms a reaction structure, 000 minimizing deflection of the stationary jaw is important because deflection can lead to inaccuracies in the workpiece.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

One general aspect includes a vise having a vise body. The vise body has a base with spaced apart rails joined to the base, each rail including a flange with a surface having a slot. A movable jaw assembly is slidable on the surfaces is driven by an actuator supported by the vise. A stationary jaw has a key configured to engage the slots and has a surface facing the movable jaw assembly. Fasteners secure the stationary jaw to the vise body, where all of the fasteners extend through the surfaces of the vise body between the slots and the surface of the stationary jaw facing the movable jaw assembly.

Embodiments may include one or more of the following features. The fasteners can include two fasteners in total where one fastener engages each flange. The fasteners can include bolts and each of the flanges include threaded apertures configured to threadably receive the bolts. The fasteners can include four fasteners in total where two fasteners engage each flange. The fasteners can include a plurality of three or more fasteners engaging each flange. The key can comprise a single key, or two keys where one key engaging each of the slots.

DETAILED DESCRIPTION OF ILLUSTRATIVE EMBODIMENTS

Figure 1:
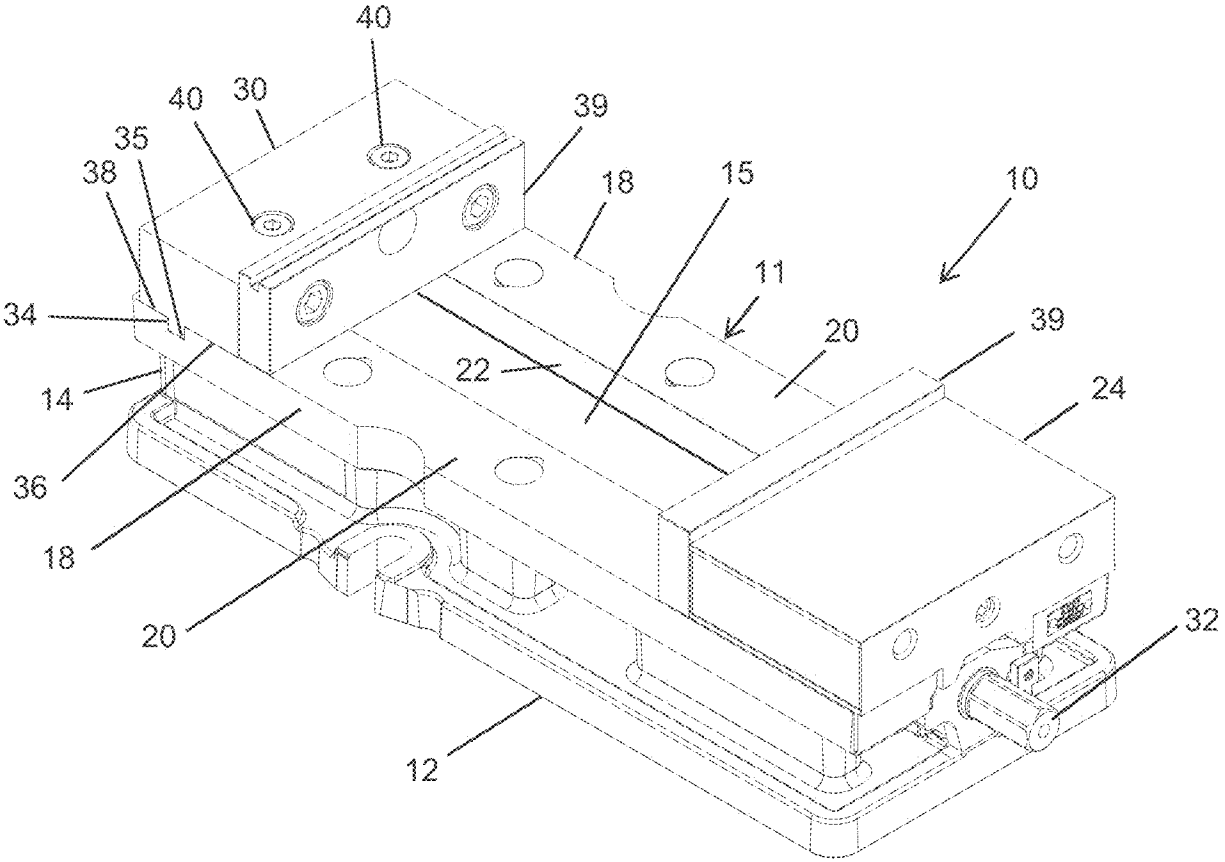
FIG. 1 is a perspective view of a vise.

An exemplary vise 10 having aspects of the present invention includes a vise body 11 that extends longitudinally along a central axis. The vise body, 11, includes a base plate or wall 12 and upstanding side rails 14 on opposite sides thereof.

The upstanding rails 14 have upper flanges 18 on opposite sides of the central axis with coplanar upper surfaces 20 on top of the upper flanges 18 and inwardly facing side rail surfaces 22 that are spaced apart (one of which is illustrated). The surfaces 20 define a jaw guide space and extend along the length of the vise body 11. The surfaces 20 guide a floating vise jaw assembly indicated generally at 24. The rails 14 are spaced to form a longitudinally extending recess 15.

The vise jaw assembly 24 moves in the recess 15 as guided by the surfaces 20 of the side rails 14 toward and away from a stationary jaw 30 with a suitable drive actuator, herein comprising a vise screw 32 having a handle (not shown). The vise jaw assembly 24 threadably mates with the vise screw 32 where rotation of the vise screw 32 moves the vise jaw assembly 24 toward or away from the stationary jaw 30. It should be understood that the vise screw 32 is but one form of drive actuator, and should not be considered limiting. Other forms of drive actuators including hydraulic and pneumatic actuators can also be used.

The stationary jaw 30 is removably mounted to the rails 14 on the upper surfaces 20. The stationary jaw 30 includes a projection or key 34 on a lower surface thereof that mates with slots 35 provided in the upper surfaces 20. The key 34 is commonly formed integral from a single unitary body with other portions of the stationary jaw 30. Fasteners 40 typically comprising threaded bolts secure the stationary jaw 30 to the vise body 11. Commonly, threaded apertures (not shown) are provided in the flanges 18.

Figure 2:
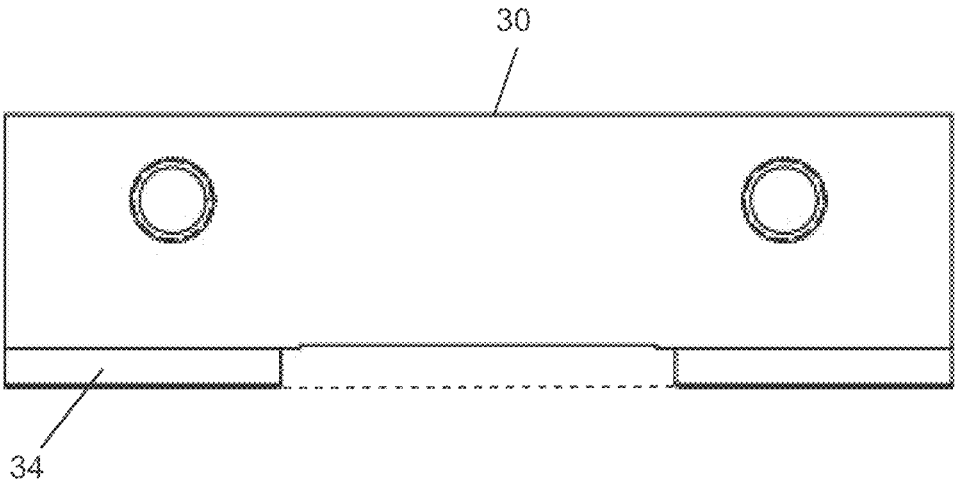
FIG. 2 is an elevational view of a stationary jaw.

It should be noted that all the fasteners 40 are disposed on a side 36 of the upper surfaces 20 relative to the key 34 and slots 35 that are closest to the movable vise jaw assembly 24. In prior art vises, the fasteners (bolts) are secured to threaded apertures also on a side 38 opposite to side 36 of the key 34 and slots 35 (see for example the modeled representation of a prior art vise in FIG. 3 with fasteners 40A and 40B). Replaceable jaw plates 39 are commonly used on both the movable jaw assembly 24 and the stationary jaw 30. The key 34 can comprise two key portions each configured to a slot 35 in each surface 20 illustrated in FIG. 2. Alternatively, the key 34 can comprise a single key illustrated in part with a dashed line.

Figure 3:
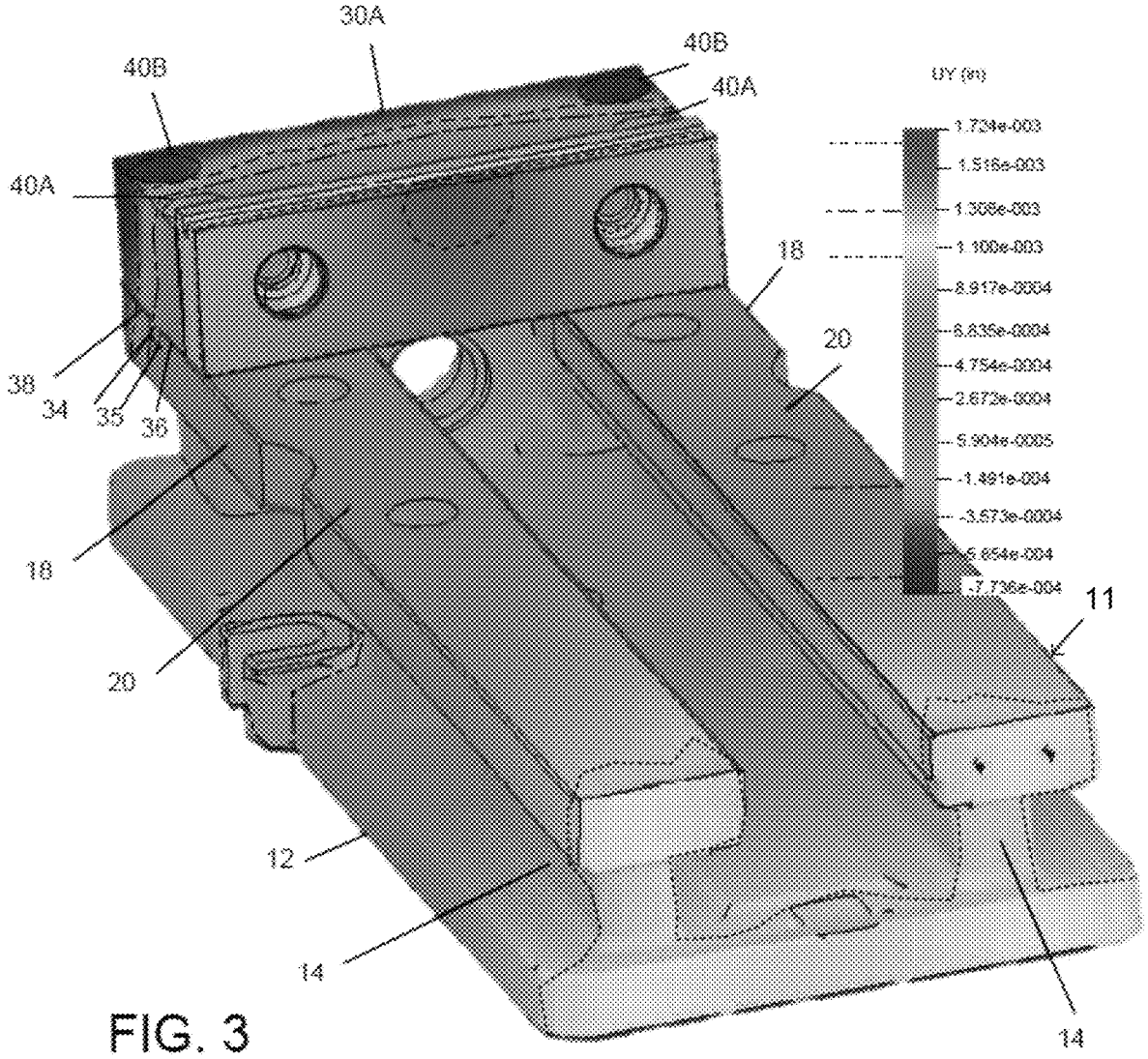
FIGS. 3 and 4 are finite element analysis modeled representations of vise bodies.
Figure 4:
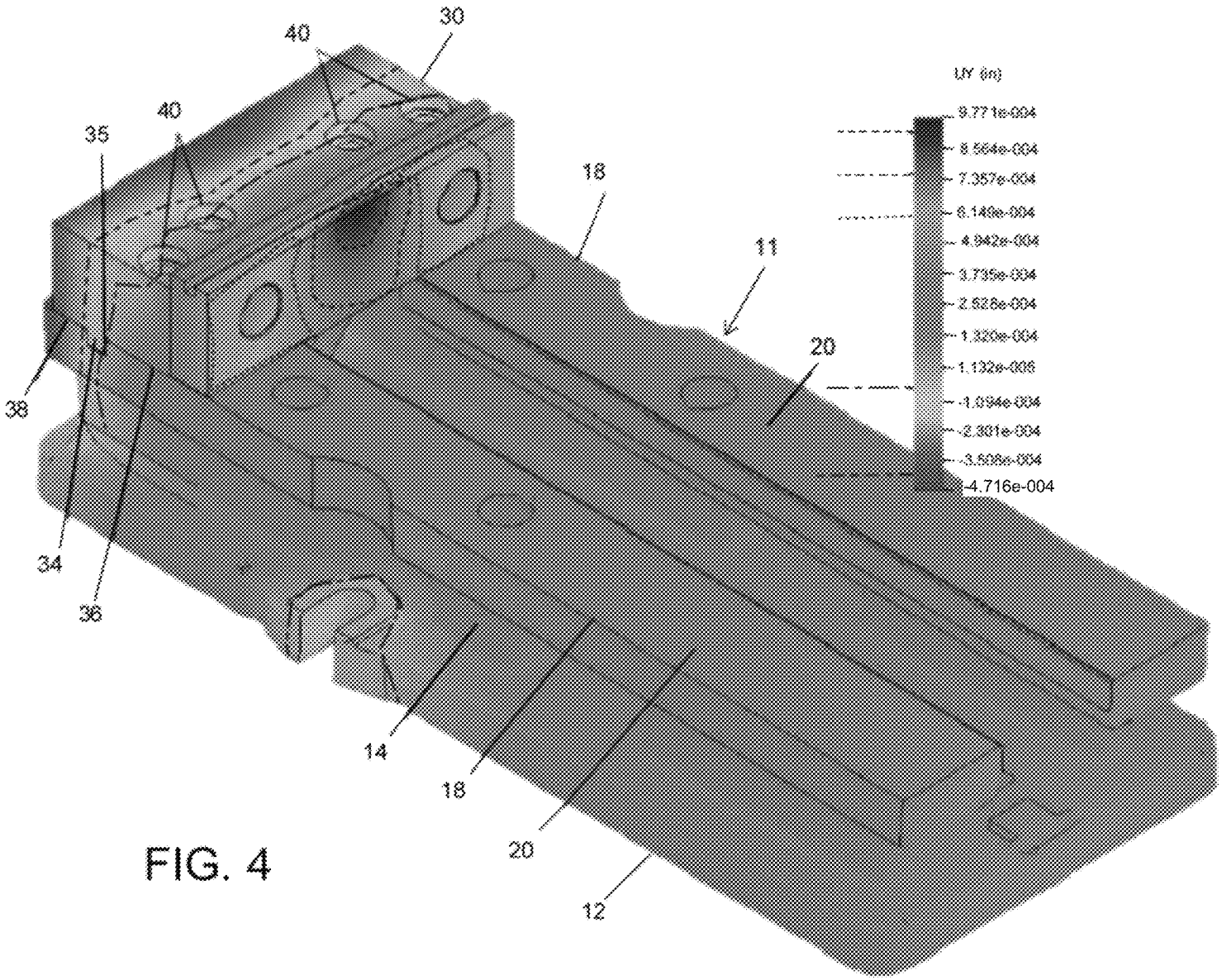

It has been discovered that securing the vise 10, the stationary jaw 30 with fasteners 40 only on the side 36 improves the performance characteristics of vise 10 by minimizing vertical deflection of the stationary jaw 30 when a workpiece is clamped between the stationary jaw 30 and the vise jaw assembly 24. This is illustrated by comparing FIGS. 3 and 4. As stated earlier, FIG. 3 is a modeled representation (finite element analysis) of a known prior art vise with a stationary jaw 30A having fasteners 40A on side 36 and fasteners 40B also on side 38. In contrast, FIG. 4 is a modeled representation of a vise having fasteners 40 only on side 36. In this comparison, four fasteners are used on each vise of FIGS. 3 and 4, but the number of fasteners can vary. FIG. 3 illustrates that the stationary jaw 30A of the known prior art design with two fasteners 40A on side 36 and two fasteners 40B on side 38 created 0.001724 inches of lift of the stationary jaw 30A for a modeled workpiece held between the stationary jaw 30A and movable jaw assembly 24A. However, for the same modeled workpiece held between the stationary jaw 30 and jaw assembly 24 having four fasteners 40 only on side 36 of the key 34 and slots 35 with the same amount of force created 0.00097 inches of lift of the stationary jaw 30. Identical jaw plates 39 are provided in each model.

It is believed similar comparative results would be seen if the number of fasteners is the same for each vise in the comparison. It should be noted that typically the number of fasteners used to secure the stationary jaw vise 30 to the vise body 11 is at least two or more fasteners. In view of the spaced apart rails 14 it is preferable that at least one fastener be used for securing the stationary jaw 30 to each rail 14. In other embodiments, three or more fasteners can be used to secure the stationary jaw 30 to each of flanges 18 of the rails 14.

In the each of the modeled representations of FIGS. 3 and 4, the vise bodies are identical (but for the location of the fasteners) being modeled as being made of ductile iron grade 80-55-06, the stationary jaws and jaw plates being made of AISI 1018 CRS and secured to the base body 7/16"×2" low head SHCS Grade 5 @ 50 ft/lbs.

The improved stationary jaw and the manner of mounting the same to a vise body thus improves the performance of the vise, which improves accuracy of workpieces manufactured with the vise since vertical deflection of the workpiece when secured to the vise is reduced over known vises. In addition to improved performance, cost savings are provided when manufacturing the vise due to elimination of fasteners, those behind the key and slots, that do not contribute significantly to securing the stationary jaw to the vise body. It should be noted that aspects of the invention are not limited to the exemplary vise herein described and illustrated. Aspects of the invention, in particular location of all the fasteners used to secure the stationary jaw to the vise body relative to key and surface(s) facing movable jaw assemblies can be applied to many types of stationary jaws having keys engaging slot(s) provided in many forms of vise bodies.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. A vise comprising: a vise body having a base with spaced apart rails joined to the base and forming a longitudinally extending recess between the spaced apart rails, each rail including a flange with a surface, each of the surfaces of the rails including a slot; a movable jaw assembly slidable on the surfaces; an actuator supported by the vise body and connected to the movable jaw assembly, the actuator being configured to move the movable jaw assembly; a stationary jaw having at least one key configured to engage the slots, the stationary jaw having a lower surface in contact with the surfaces of the flanges, an upper surface facing in a direction opposite the lower surface, and a surface facing the movable jaw assembly; and four fasteners securing the stationary jaw to the vise body, all of the fasteners extending through the surfaces of the vise body between the slots and the surface of the stationary jaw facing the movable jaw assembly, wherein each fastener extends downward through a bore in the stationary jaw extending from and through the upper surface to and through the lower surface and into an aperture provided in the flange, each bore and aperture disposed between the at least one key and the surface of the stationary jaw facing the movable jaw assembly, wherein the fasteners are arranged in two pairs of fasteners, each pair of fasteners being secured to one of the flanges, wherein a first fastener of each pair of fasteners is located closer to the longitudinally extending recess than a second fastener of each pair of fasteners, and wherein one of the fasteners of each pair of fasteners is closer to the associated slot than the other fastener of each pair of fasteners.

2. The vise of claim 1, wherein the at least one key comprises a single key.

3. The vise of claim 1, wherein the at least one key comprises two keys, one key engaging each of the slots.

4. The vise of claim 1 wherein the fasteners comprise threaded bolts and each of the flanges include threaded apertures configured to threadably receive the bolts.

5. The vise of claim 1 wherein sail one of the fasteners of each pair of fasteners is the first fastener of each pair of fasteners.

6. The vise of claim 5 wherein each stationary jaw includes a removable jaw plate secured to the surface with two jaw plate fasteners, wherein the first and second fasteners of each pair of fasteners are disposed on opposite sides of one of the jaw plate fasteners.

7. The vise of claim 1 wherein each stationary jaw includes a removable jaw plate secured to the surface with two jaw plate fasteners, wherein the first and second fasteners of each pair of fasteners are disposed on opposite sides of one of the jaw plate fasteners.

8. A vise comprising: a vise body having a base with spaced apart rails joined to the base and forming a longitudinally extending recess between the spaced apart rails, each including a slot and two threaded apertures; a movable jaw assembly slidable on the rails; an actuator supported by the vise body and connected to the movable jaw assembly, the actuator being configured to move the movable jaw assembly; a stationary jaw having at least one key configured to engage the slots, the stationary jaw having a lower surface in contact with rails, an upper surface facing in a direction opposite the lower surface, and a surface facing the movable jaw assembly; and four threaded bolts extending through the stationary jaw, each threaded bolt threadably engaging one of the threaded apertures provided in the rails, and wherein all of the threaded bolts extend downward through the stationary jaw into the rails between the at least one key and the surface of the stationary jaw facing the movable jaw assembly, wherein the four threaded bolts are arranged in two pairs of threaded bolts, each pair of threaded bolts being secured to one of the rails, and wherein a first threaded bolt of each pair of threaded bolts is located closer to the longitudinally extending recess than a second threaded bolt of each pair of threaded bolts, and wherein one of the threaded bolts of each pair of threaded bolts is closer to the associated slot than the other threaded bolt of each pair of threaded bolts.

9. The vise of claim 8, wherein the at least one key comprises a single key.

10. The vise of claim 8, wherein the at least one key comprises a single key.

11. The vise of claim 8 wherein said one of the threaded bolts of each pair of threaded bolts is the first threaded bolt of each pair of threaded bolts.

12. The vise of claim 11 wherein each stationary jaw includes a removable jaw plate secured to the surface with two jaw plate fasteners, wherein the first and second threaded bolts of each pair of threaded bolts are disposed on opposite sides of one of the jaw plate fasteners.

13. The vise of claim 8 wherein each stationary jaw includes a removable jaw plate secured to the surface with two jaw plate fasteners, wherein the first and second threaded bolts of each pair of threaded bolts are disposed on opposite sides of one of the jaw plate fasteners.

* * * * *